US008077026B2

(12) United States Patent
Jobe et al.

(10) Patent No.: US 8,077,026 B2
(45) Date of Patent: Dec. 13, 2011

(54) TECHNICIAN COMMUNICATIONS FOR AUTOMATED BUILDING PROTECTION SYSTEMS

(75) Inventors: Michael L. Jobe, Wayne, NJ (US); Troy Cool, Pleasant Hill, CA (US); Joseph Grant, Davie, FL (US)

(73) Assignee: Siemens Industry, Inc., Alpharetta, GA (US)

( * ) Notice: Subject to any disclaimer, the term of this patent is extended or adjusted under 35 U.S.C. 154(b) by 490 days.

(21) Appl. No.: 11/425,901

(22) Filed: Jun. 22, 2006

(65) Prior Publication Data

US 2007/0241878 A1 Oct. 18, 2007

Related U.S. Application Data

(63) Continuation-in-part of application No. 11/403,711, filed on Apr. 13, 2006.

(51) Int. Cl.
*G08B 29/00* (2006.01)

(52) U.S. Cl. ..... 340/506; 340/514; 340/539.18; 340/539.1; 340/539.2; 340/525

(58) Field of Classification Search ..... 340/506, 340/514, 538, 10.2, 521, 539.22, 825.36, 340/825.49, 539.1, 539.17
See application file for complete search history.

(56) References Cited

U.S. PATENT DOCUMENTS

| | | | | |
|---|---|---|---|---|
| 3,668,682 | A | 6/1972 | Barbee et al. | |
| 5,850,180 | A * | 12/1998 | Hess | 340/541 |
| 6,281,790 | B1 * | 8/2001 | Kimmel et al. | 340/506 |
| 6,453,687 | B2 * | 9/2002 | Sharood et al. | 62/127 |
| 6,950,016 | B2 * | 9/2005 | Farley | 340/514 |
| 7,009,510 | B1 | 3/2006 | Douglass et al. | |
| 7,378,952 | B2 * | 5/2008 | Pumpelly et al. | 340/538 |
| 2004/0041703 | A1 * | 3/2004 | Bergman et al. | 340/514 |
| 2004/0145465 | A1 * | 7/2004 | Stults et al. | 340/521 |
| 2004/0160309 | A1 * | 8/2004 | Stilp | 340/10.2 |
| 2004/0186739 | A1 | 9/2004 | Bolles et al. | |
| 2004/0201475 | A1 * | 10/2004 | Menard et al. | 340/539.17 |
| 2005/0099299 | A1 * | 5/2005 | Tyroler et al. | 340/572.1 |
| 2005/0156731 | A1 | 7/2005 | Chapman et al. | |
| 2005/0219048 | A1 * | 10/2005 | Kimmel et al. | 340/511 |
| 2005/0280527 | A1 * | 12/2005 | Farley | 340/514 |
| 2007/0096901 | A1 * | 5/2007 | Seeley et al. | 340/539.18 |
| 2007/0139183 | A1 * | 6/2007 | Kates | 340/521 |
| 2007/0146128 | A1 * | 6/2007 | Pumpelly et al. | 340/538 |

(Continued)

FOREIGN PATENT DOCUMENTS

CH 581363 A5 10/1976

(Continued)

OTHER PUBLICATIONS

Siemens MXL update—2002.

(Continued)

*Primary Examiner* — Hoi Lau

(57) ABSTRACT

A communication module communicates between the tools or control panel and the technician. A communications module connects to or by the control panel or other controller of the protection system. The communications module wirelessly communicates with a service tool, such as a personal data assistant. The technician may control the protection system with the service tool from a remote location, such as by a monitoring device or other component being tested. The communications module may be taken with the technician when testing is complete or left in the building for later use. The communications module is provided as part of the protection system or is added at a later time to an existing system.

21 Claims, 7 Drawing Sheets

U.S. PATENT DOCUMENTS

| | | | | |
|---|---|---|---|---|
| 2007/0194907 | A1* | 8/2007 | Tawil | 340/514 |
| 2007/0241866 | A1* | 10/2007 | Cool et al. | 340/10.41 |
| 2007/0241877 | A1* | 10/2007 | Jobe et al. | 340/506 |
| 2007/0241878 | A1* | 10/2007 | Jobe et al. | 340/506 |
| 2007/0241879 | A1* | 10/2007 | Jobe et al. | 340/506 |

FOREIGN PATENT DOCUMENTS

| | | | |
|---|---|---|---|
| EP | 1296301 | | 3/2003 |
| WO | 9505627 | A1 | 2/1995 |
| WO | WO 01/16912 | | 3/2001 |
| WO | 2006034246 | A2 | 3/2006 |

OTHER PUBLICATIONS

Siemens: NCCNT-G, NCCNT-GL—FireFinder NCCNT Command Center System—2004.

Siemens Synova Fire Protection—The SynoLINE system—2005.

Siemens Synova Fire Protection—The SynoLOOP system.

Siemens Synova Fire Protection System—The FC700A Network System.

Siemens Basic Fire Protection System—2002.

Siemens Networked Fire and Voice Evacuation Systems—2002.

Siemens Networked Fire System—2002.

Siemens MXL Advanced Protection System—Jan. 2006.

Siemens MXL—VDT Interactive Video Display Terminal—Apr. 2003.

EH&S Manual 6930 Fire Protection Systems; pp. 1-7; Apr. 19, 2002.

RCMP Detachments—Fire Protection Design Requirements Web print-out—Mar. 20, 2006.

Siemens Fire Synova Products & Accessories Catalogue 2005.

* cited by examiner

| | |
|---|---|
| ALARMS=001 | SUPERVISORY=002 |
| TROUBLES=004 | SECURITY=002 |

| | | |
|---|---|---|
| ALARM<br>ACK | *ALARM | #POWER |
| AUD<br>SIL | *AUDIBLE<br>SILENCE | ^PART SYS<br>DISABLE |
| SUPV<br>ACK | *SUPERVISORY | ^Off<br>*On<br>#Blink |
| TRBL<br>ACK | *TROUBLE | ?Unknown |
| SEC<br>ACK | *SECURITY | |
| RESET | DISP<br>NEXT | QUIT |

Job: mike16june06

Figure 7

TECHNICIAN COMMUNICATIONS FOR AUTOMATED BUILDING PROTECTION SYSTEMS

RELATED APPLICATIONS

The present patent document is a continuation-in-part of application Ser. No. 11/403,711 filed Apr. 13, 2006 for "Wireless Service Tool for Automated Protection Systems," which is hereby incorporated by reference.

BACKGROUND

The present embodiments relate to automated protection systems, and particularly to remote servicing, monitoring and/or control of building fire and security systems.

Fire and security protection systems include distributed components that together form an automated system for monitoring for and protecting against hazards within a building or facility. The system automatically detects and reports hazards, such as a fire, smoke, combustion, or an intrusion. The system may report a hazard by sounding an alarm and/or notifying an agent, such as a local fire protection organization. The system may trigger an appropriate corrective action, such as activating a deluge and/or extinguishing system. Similarly, the system may identify a hazard in response to the tripping of an extinguishing or deluge system. The system may be integrated with other building systems that manage heating, ventilation, air conditioning (HVAC), environmental air quality, or other controlled applications for a building or facility. These other building systems may perform building protection functions so may also be building protection systems.

Components of a fire and security protection system include sensors, heat detectors, smoke detectors, CO detectors, $CO_2$ detectors, motion detectors, alarms, sirens, annunciators, power supplies, displays, monitors, control panels, air samplers, extinguishers, valves, actuators, call switches and/or other devices used for detecting hazards within a building. Components monitor environmental conditions to detect hazardous conditions, provide user access points, monitor status of detectors, and/or provide security monitoring for the building or portions of a building. The system components may communicate through wired and/or wireless connections.

Tools are used to configure and/or verify a configuration of the fire protection system (i.e., commission), diagnostic testing, servicing and troubleshooting the system. Tools may be used for periodic and/or annual testing or performance verification of the system. The tools include a user interface for indicating alarm, trouble, supervisory or security triggers. Acknowledgement, silencing, reset or other functions may be controlled by a tool. The tools are hardwired to a dedicated access point within a building, such as a control panel. Where the control panel is at a different location in the building than a component being tested or controlled, multiple technicians or extra time may be needed to verify operation. For example, one technician operates the tools while another technician uses a two-way radio to communicate by voice any resulting actions at the remote component. Servicing, troubleshooting and monitoring of the fire protection system may be labor-intensive.

Building protection systems may be regulated by local government. Frequently, testing or commissioning reports must be submitted as part of the regulations. The tools may be accessed by a communications port, such as RJ12 port, for connection with a laptop computer. The data generated by the tools is output to the laptop. The laptop includes a report generation tool. The laptop is then connected with a printer to output the report. However, the laptop adds undesired bulk and weight for a technician, and porting the laptop to a printer location may be time consuming.

BRIEF SUMMARY

By way of introduction, the embodiments described below include methods, processes, apparatuses, computer readable media, and systems for communicating and/or reporting in automated protection systems. Automated protection systems include fire protection systems, automated security systems and/or integrated systems having automated fire and/or security protection capabilities (collectively and/or individually "protection systems").

A communication module communicates between the tools or control panel and the technician. A communications module connects to or by the control panel or other controller of the protection system. The communications module wirelessly communicates with a service tool, such as a personal data assistant. The technician may control the protection system with the service tool from a remote location, such as a location at a monitoring device or other component being tested. The communications module may be taken with the technician when testing is complete or left in the building for later use. The communications module is provided as part of the protection system or is added at a later time to an existing system.

In a first aspect, a system is provided for communications in automated protection of a building environment. A protection system for a building has one or more monitoring devices. A communications module connects with the protection system and is operable to communicate wirelessly with a portable service tool.

In a second aspect, a system is provided for communications in automated protection of a building environment. A protection system for a building has one or more monitoring devices. A communications module external to the protection system connects with a communications port on the protection system and is operable to communicate wirelessly.

In a third aspect, a method is provided for communications in automated protection of a building environment. A transceiver device is connected near a panel or controller of a building protection system with the panel or controller. The panel or controller monitors one or more devices. The panel or controller generates at least one output signal as a function of the monitoring. The transceiver device receives at least one output signal. Data associated with the at least one output signal is wirelessly transmitted from the transceiver device to a handheld user interface.

The present invention is defined by the following claims. Nothing in this section should be taken as a limitation on those claims. Further aspects and advantages of the invention are discussed below in conjunction with the preferred embodiments and may be later claimed independently or in combination.

BRIEF DESCRIPTION OF THE DRAWINGS

The components in the figures are not necessarily to scale, emphasis instead being placed upon illustrating the described principles. In the figures, like reference numerals designate corresponding parts throughout the different views.

FIG. 7 is an example display screen of a portable service tool.

DESCRIPTION OF THE PRESENTLY PREFERRED EMBODIMENTS

Figure 5:
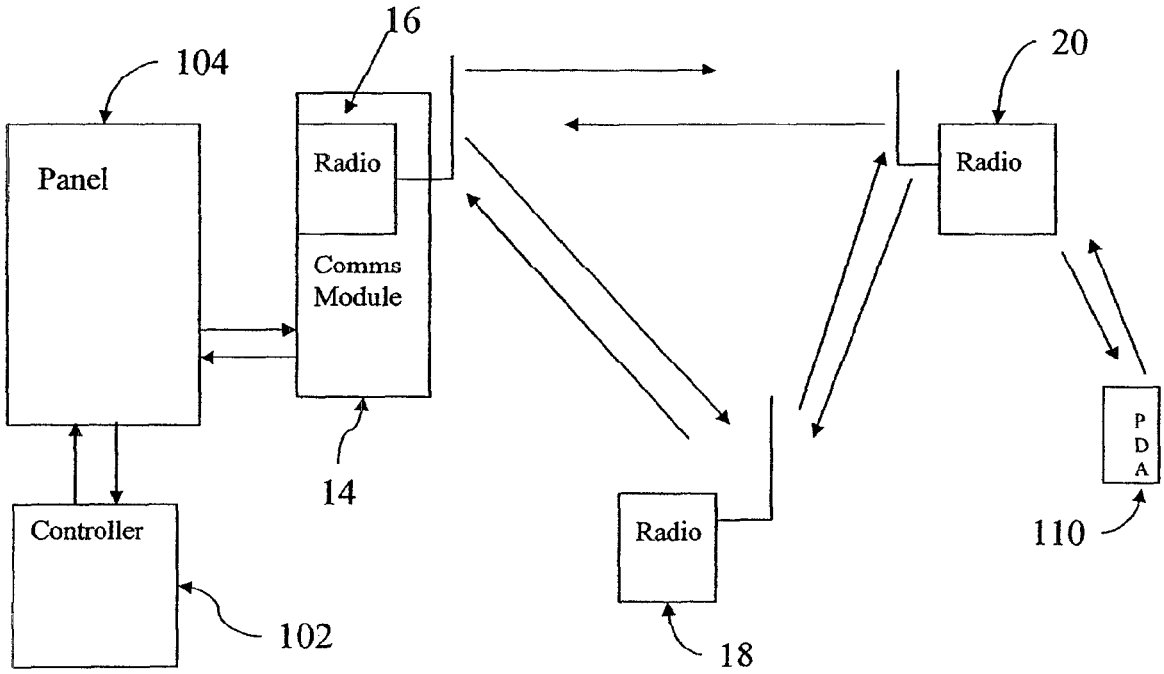
FIG. 5 is a block diagram of one embodiment of communications between a protection system and a portable service tool.
Figure 6:
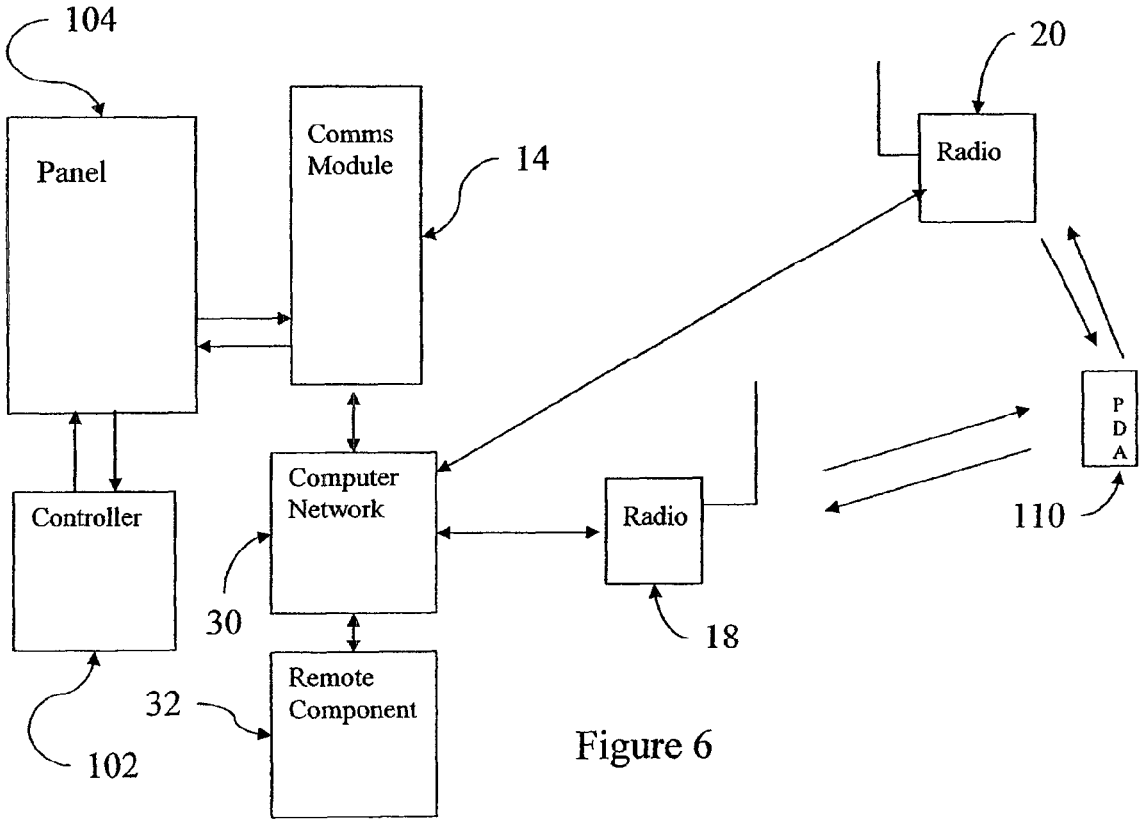
FIG. 6 is a block diagram of one embodiment of communications between a protection system and a computer network.

FIGS. 1-4 show embodiments for a portable service tool and the use of the portable service tool with a protection system. FIGS. 5-6 shows protection systems with an added communications module for use with or without the portable service tool. The communications module may be separate from or designed as part of the protection system.

Regarding FIGS. 1-4, a service tool for protection systems may be used prior to, during, and after installation of a protection system and for testing of an existing system. The service tool may be a portable handheld device having a wireless transceiver for wirelessly communicating with a fire protection system. The service tool provides a remote access point to the protection system via one or more components of the protection system. The service tool may provide the same or similar functionality of the device, but at a remote location. The service tool may receive configuration and status data from a device of the protection system. A user interface for the service tool may display information associated with information collected and displayed by a device of the protection system. The service tool may be used prior to, during, or after installation of a protection system. In an example, the service tool communicates with a control panel for a fire protection system to display information provided at the control panel and to provide remote control of the fire control panel.

Figure 1:
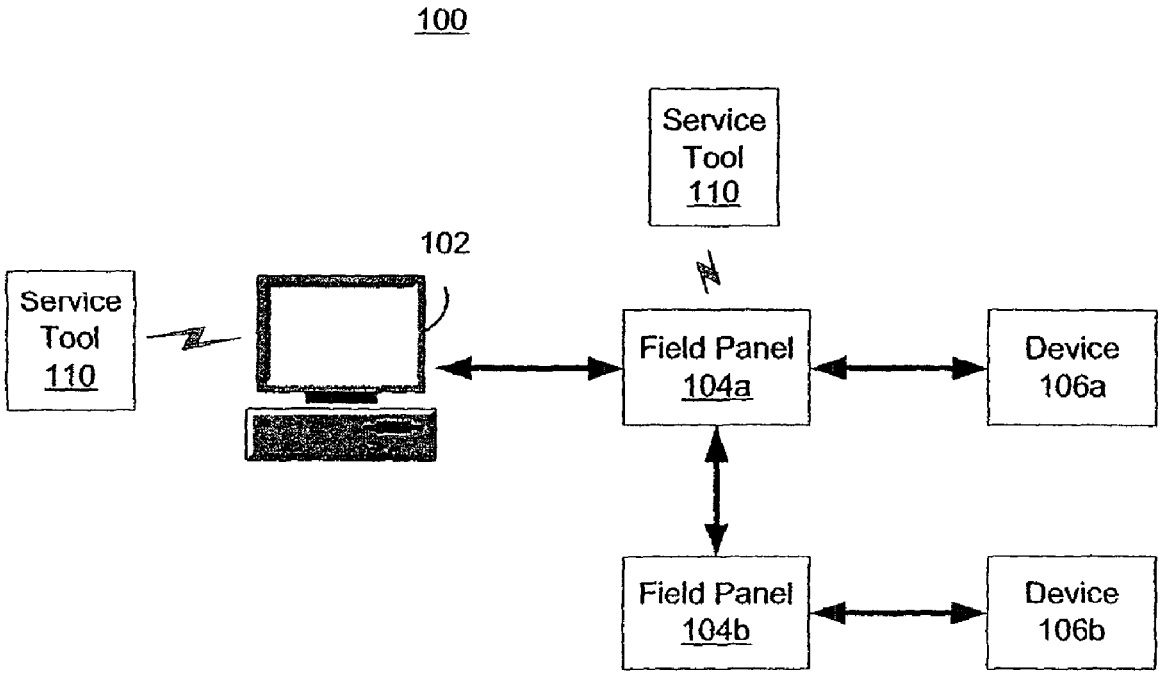
FIG. 1 is an example of a service tool used with an exemplary protection system.

FIG. 1 illustrates a block diagram of a service tool 110 and a protection system 100 that provides control functionality for one or more building, or facility, operations. The illustrated protection system 100 is configured to automate control for hazard detection, such as a fire detection and suppression system, for a building, and is provided only as an example of a type of automated system. Although various examples of the service tool 110 and protection system 100 are described, the service tool 110 may be used in a variety of applications and may be used with many devices and automated systems.

The protection system 100 includes control processes for monitoring an environment, detecting hazards, and reporting detected conditions. For example, the protection system 100 includes components, or equipment, that detect fire, combustion by-products and heat and extreme environmental changes. The components are positioned, or distributed, throughout the building or facility to provide early warnings of a fire or other potentially hazardous condition. The components may generate and/or receive information related to a specific event, condition, status, acknowledgement, silence, alarm, control, user access, combinations thereof and the like. The components also or alternatively may be responsive to signals, may route communications, and/or may carry out a received instruction. The components may communicate or route the information between and among components of the system from a source to a destination. For example, the automated building protection system includes a building security and loss protection system, a burglary/intrusion detection system, a HVAC system, air quality system, industrial control system, hazard detection and/or prevention system, a lighting system, combinations or integrations thereof, and the like. In an embodiment, the protection system 100 may be one of the FireFinder XLS®, MXL or NCC, systems available from Siemens Building Technologies, Inc. of Florham Park, N.J.

The protection system may be arranged in one or more zones. Each zone may have multiple components for detecting and reporting hazards. The components of a zone may communicate using a loop communication and/or over a bus. The protection system 100 includes a central panel, or field control panel 104*a*. More or less field panels 104*a* may be arranged in the protection system 100 than shown in FIG. 1. The field panel 104*a* collects information related to operational status of the system and its components. The field panel 104*a* monitors one or more zones of the protection system.

The information collected or monitored at the field panel 104*a* is provided via a user interface. The user interface may include lights, LED's, video or picture display, a monitor, graphics array, and textual data. In an embodiment, the field panel 104*a* is a fire control panel having video display for presenting real-time information associated with the protection system. The display may illustrate that the system is operating properly and that the components, or detectors, of a monitored zone are properly operating. The display may also indicate that a hazard has been detected and provide information as to the type and location of the detected hazard. The display may be used to provide other diagnostic, and service information. A user may select to view a status of the system as a whole, or its subparts, such as a zone, or specific detectors and actuators of a zone. The field panel 104*a* may also include a network interface, a communications device, such as a telephone, a microphone or call system, a terminal module, a power supply, a processor and other devices for administering control for the protection system.

The field panel 104*a* may be networked with other one or more other field panels 104*b*. The field panel 104*b* may be configured similar to field panel 104*a*. For example, field panel 104*a* may be a central field panel for a large multi-story building, and field panel 104*b* may be arranged as a central panel for a floor of the building. Field panels 104*a* may be communicatively coupled with field panel 104*b* to report information received at the field panel 104*b*. The field panels 104*a* and 10*b* may be arranged in a bus configuration where the field panels 104*a* and 104*b* are mutually communicatively coupled to a common bus, a loop configuration where the panels are connected in series to form a loop, and/or in a star configuration, where multiple control panels are coupled to a central control panel. Field panel 104*a* also may be arranged to receive and report information from one or more devices 106*a*. Field panel 106*b* may be arranged to receive and report information from one or more devices 106*b*.

The field panels 104 and the devices 106 may communicate information using a wired connection and/or wireless connection in accordance with a wireless communications protocols. For example, the field panels 104 may wirelessly communicate information using a 802.15.4 communications protocols, IEEE 802.11x (e.g., 802.11a 802.11b, 802.11c . . . 802.11g), Wi-Fi, Wi-Max, Bluetooth, ZigBee, Ethernet, or other proprietary, standard, now known or later developed wireless communication protocols. Any now known or later developed network and transport algorithms may be used. Communication, transport and routing algorithms are provided on the appropriate devices. Any packet size or data format may be used.

Control and monitoring of a protection system are distributed to the field panels 104. A monitoring device 106*a* may periodically or continuously report a status of a monitored condition to field panel 106*a*. When the device 106*a* detects a hazard, the device 106*a* reports appropriate information to the field panel 106*a*. The field panel 104*a* processes the information to take appropriate action, such as sounding an alarm and reporting the condition. The field panel 104*a* may activate actuators, such as fan or door lock, in the area where a hazard was detected. The field panel 104*a* controls the device 106*a*, such as requesting an acknowledge from a component or components of a zone, silencing an alarm, or overriding a detected condition, supervisory overriding, resetting the protection system 100, and arming and disarming of device 106*a*. The field panels 104 may report information, such as sensitivity settings for devices, voltages and battery supply information, a log of events, and other information relevant to the protection system 100.

The monitoring devices 106 may be a detector, a sensor, a manual call unit or other device that reports conditions and/or events. The devices 106 may be configured as a temperature or heat sensor, smoke detector, humidity sensor, fire sensor, occupancy sensor, air quality sensor, gas sensor, $O_2$, $CO_2$ or CO sensor or other now known or later developed sensors. The devices 106 may include micro-electro-mechanical sensors ("MEMS") or larger sensors for sensing any environmental condition or event. Additionally or alternatively, the devices 106 may be an actuator configured to perform an act in response to instructions, such as a command received from a field panel 104. As an actuator, the devices 106 may be arranged to control a damper, a heating or cooling element, sprinkler, valve, fan, strobe, lighting, alarm, bell, motor, or other device. One device 106 may be both an actuator and a monitoring device. Separate devices 106 for different functions may be used.

The exemplary protection system 100 may include at least one workstation 102 as a controller of the protection system 100. The workstation 102 may be an interactive video display terminal that provides a secondary display of information and operation of functions of the field control panel 104*a*. The workstation 102 may provide user access to the components of the protection system 100, such as the field panels 104*a* and 104*b* and devices 106*a* and 106*b*. The workstation 102 accepts modifications, changes, and alterations to the protection system 100. The workstation 102 may have a user interface with an input device or combination of input devices, such as a keyboard, voice-activated response system, a mouse or similar device. The workstation 102 may affect or change operations of the field panels 104*a* and 104*b*. The workstation 102 may process data gathered from the field panels 104*a* and 104*b* and maintain a log of events and conditions.

The service tool 110 may communicate with the protection system 100 through a communication connection with one or more components of the system 100. The service tool 110 may communicate information using a wireless data transmission protocol. For example, the service tool 110 may wirelessly communicate with the field panel 104*a* and/or workstation 102. The service tool 110 also may communicate with field panel 104*b* directly or through a wireless communication with field panel 104*a* and/or workstation 102.

Figure 2:
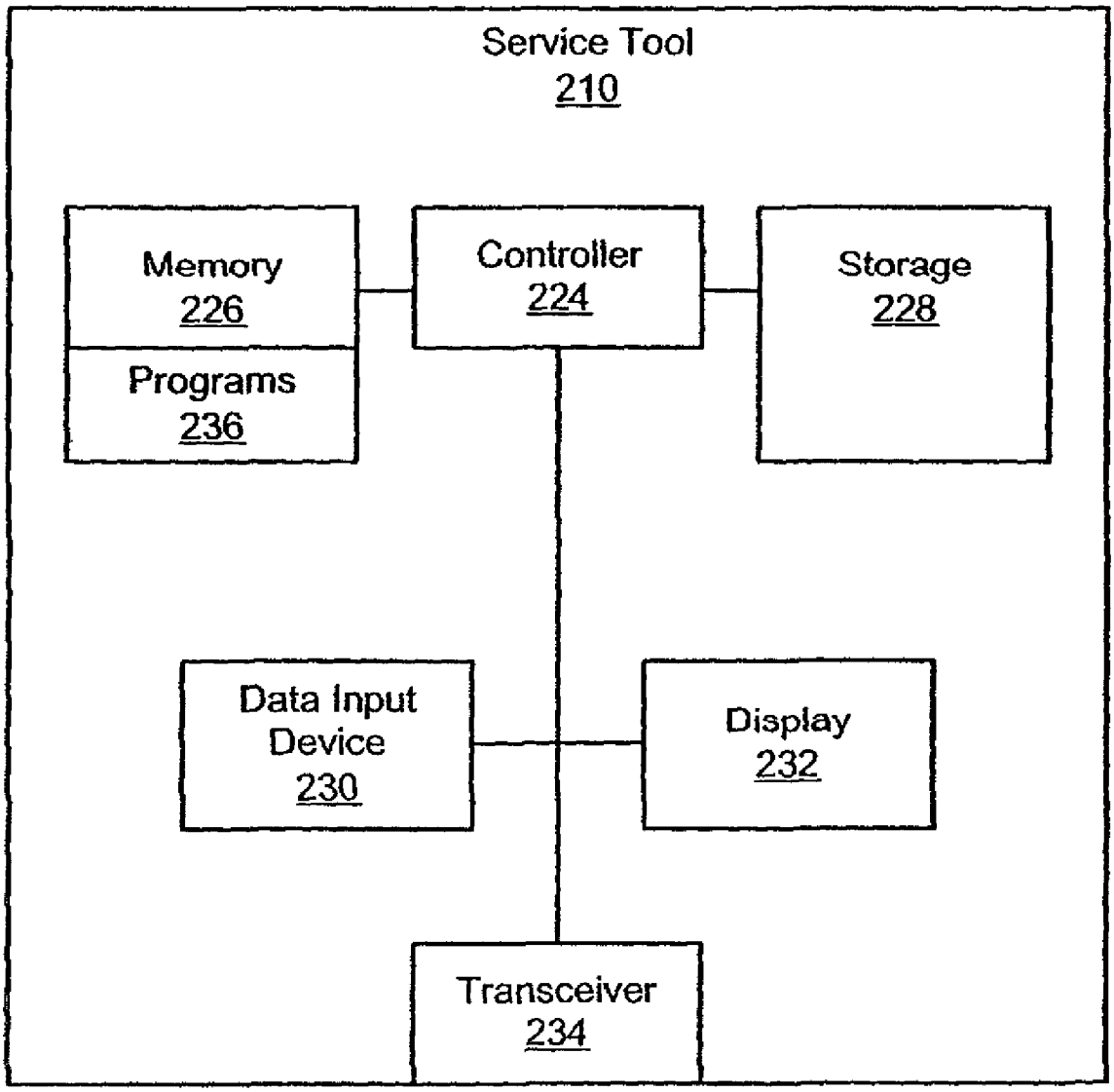
FIG. 2 illustrates a block diagram for an exemplary service tool for a protection system.

FIG. 2 illustrates a block diagram for an exemplary portable service tool 210. The service tool 210 may be any device or network of devices that may be configured or programmed to provide service functionality for a protection system. The service tool 210 may be a personal digital assistant ("PDA"), data processor, desktop computer, mobile computer, notebook computer, tablet computer, controller system, personal computer, workstation, mainframe computer, server, personal communications device such as a cellular telephone, network of computers such as a Local Area Network ("LAN"), a Wireless LAN ("WLAN") a Personal Area Network ("PAN"), Wireless PAN ("WPAN") and a Virtual Private Network ("VPN"), combinations thereof and the like. For example, the service tool 210 is a portable handheld device that communicates with a control panel 104 via a controller communicatively coupled with the control panel 104.

The service tool 210 includes a controller 224, or central processing unit (CPU), memory 226, storage device 228, data input device 230, data output 232, and transceiver 234. The service tool also includes one or more mains and/or battery power connections (not shown), such as a 120 Vac, 24 Vac, 24 Vdc 12 Vdc, 9 Vdc and like power connections for supplying operating power for the service tool 210. The data output device 232 may be a display, monitor, a printer, a communications port, combinations thereof and the like.

A program 236 resides in the memory 226 and includes one or more sequences of executable code or coded instructions. The memory may be a random access memory ("RAM"), read-only memory ("ROM"), programmable read-only memory ("PROM"), erasable programmable read only memory ("EPROM"), electronically erasable programmable read only memory ("EEPROM"), Flash memory or any combination thereof or any memory type existing now or in the future. The program 236 may be implemented as computer software or firmware including object and/or source code, hardware, or a combination of software and hardware. The program 236 may be stored on a computer-readable medium, (e.g., storage device 228) installed on, deployed by, resident on, invoked by and/or used by one or more controllers 224, computers, clients, servers, gateways, or a network of computers, or any combination thereof. The program 236 is loaded into the memory 226 from storage device 228. Additionally or alternatively, the code may be executed by the controller 224 from the storage device 228. The program 236 may be implemented using any known or proprietary software platform or frameworks including basic, Visual Basic, C, C+, C++, J2EE™, Oracle 9i, XML, API based designs, Python, and like software systems.

The controller 224 may be a general processor, central processing unit, digital signal processor, control processor, application specific integrated circuit, field programmable gate array, analog circuit, digital circuit, combinations thereof or other now known or later developed devices for implementing a control process. The controller 224 executes one or more sequences of instructions of the program 236 to process data. Data and/or instructions are input to the service tool 210 with data input device 230. Data and/or instructions are input to the service tool 210 via the transceiver 234. The controller 224 interfaces data input device 230 and/or the transceiver 234 for the input of data and instructions. Data processed by the controller 224 is provided to an output device 232. For example, data processed by the controller may be presented in a human readable format, such as in textual, graphical, and/or video format on a monitor. The data also or alternatively may be provided in an audible format or combination audible and visual format. The data processed by the controller may be provided to an external output device, the transceiver 234 and/or stored in the data storage device 228 for later access. The controller 224 through the programs 236 may be configured to provide the functionality of the service tool 210. The controller 224 performs the instructions of the program 236 in memory 226 to provide the features of the service tool 210.

The controller 224 may also interface the storage device 228 for storage and retrieval of data.

The transceiver 234 may is a receiver, transmitter, a wireless communication port, a wireless communication device, a modem, a wireless modem or like device configured to wirelessly receive and/or transmit information. The transceiver 234 communicates information using one or a combination of one-way and/or two-way wireless communications, such as radio frequency (RF), infra-red (IR), ultrasound, cellular radio-telephone, a wireless telephone, a Personal Communication Systems (PCS) or like wireless communication technologies. The transceiver 234 may communicate information or packets of information according to one or more communications protocols or standards, including IEEE 802.11 (x), 802.14, 802.15, 802.16, Wi-Fi, Wi-Max, ZigBee, Bluetooth, Voice Over Internet Protocol (VoIP). The transceiver 234 also or alternatively may communicate information and/or packets of information in accordance with known and proprietary network protocols such as TCP/IP, Ethernet and like protocols over a Personal Area Network (PAN), Wireless PAN (WPAN), virtual private network (VPN), Wireless Local Area Network (WLAN) or other networks. The transceiver 234 may include an interrogator that wirelessly transmits signals to interrogate components of a protection system. Alternatively or in addition, the transceiver 234 may include one or more ports for a wired communication, such as RS-485, Ethernet or any other type of wire port.

Figure 3:
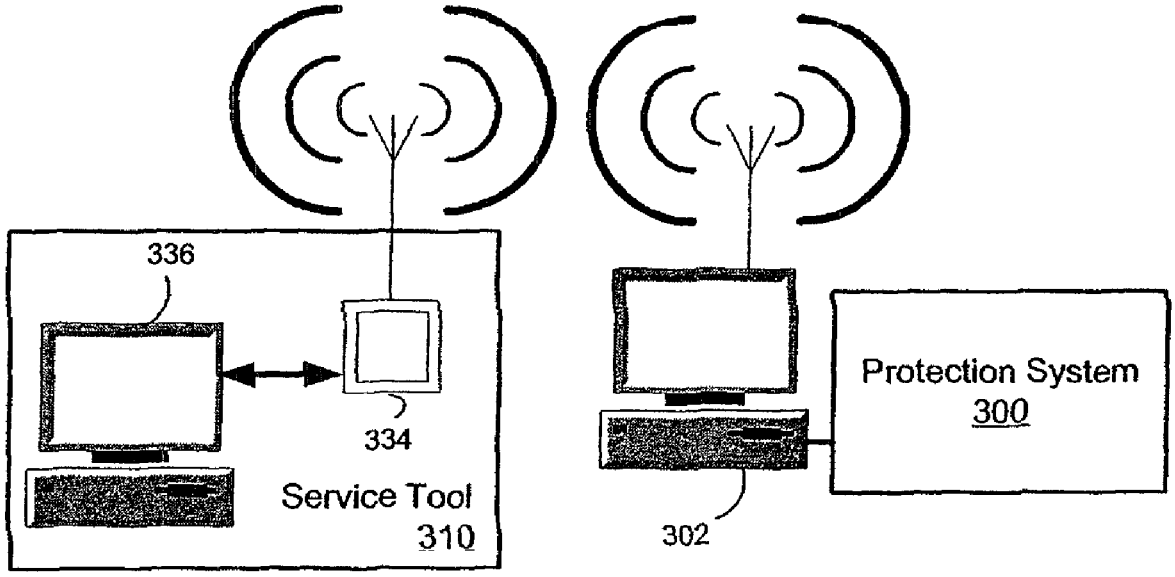
FIG. 3 illustrates an example of a wireless service tool in communication with a protection system.

FIG. 3 illustrates an example of a wireless, portable service tool 310 in communication with a protection system 300. The wireless service tool 310 includes a wireless transceiver 334 coupled to a processor 336. The protection system 300 may have a field panel coupled with a workstation 302 for communicating with the service tool. For example, the workstation 302 may be a laptop computer that is coupled via a RS-232 port or universal serial bus ("USB") to the control panel. The workstation 302 is configured to wirelessly communicate information. The workstation 302 may be programmed with software to collect or read information from one or more field panels and wirelessly report the information to the service tool 310. Using software resident on the workstation, such as Pebbles PC or other application or program, the workstation 302 provides a user interface for displaying information associated with the protection system 300. The workstation 302 may transmit the information to the service tool 310, and the service tool 310 may communicate with field panels via the workstation 302. Although shown as separate components, the workstation may be integral to the protection system 300 or component thereof.

Through the wireless transceiver 334, the service tool 310 may communicate with the workstation 302 and protection system 300 over one or more RF communication channels. The communication of information between the service tool 310 and the protection system 300 allows the service tool 310 to provide remote control and functionality of a device of the protection system 300. The service tool 310 may allow remote operation of a field panel using commands entered at the service tool and transmitted to the field panel via the workstation 302. For example, a user may enter an acknowledge, silence, reset or other field panel control command with the wireless tool 310. The wireless transceiver 334 communicates the command to the field panel, which executes the command. The wireless transceiver 334 allows remote monitoring of communications of the protection system 300. The wireless transceiver 334 may include an indicator, such as one or more blinking lights, one or more LED's and LCD display and any other indicator, to indicate the wireless transceiver 334 is receiving, transmitting, and/or monitoring, communications. The wireless communication parameters of the protection system 300 may also be manually of automatically set.

The wireless transceiver 334 wirelessly receives or reads data. The data may be provided to the processor 336. Using software, such as Pebbles PC or other application or program, the processor 336 provides a user interface to display information received by the wireless transceiver 334 from the protection system 300. The processor 336 may also include software to allow a user to wirelessly adjust, modify or test, the protection system 300 and its components. The processor 336 may store collected and/or processed data. The user interface or man-machine interface allows the service tool 310 to receive input from a user and provide information to the user. The user interface may include one or more devices such as a keyboard, mouse, touch pad, touch screen, scanner, joystick, microphone, voice recognition software, combinations thereof and the like. The interface may include a menu of options for an operation, function and/or command. Based on a selection, the service tool may control additional features of the service tool and/or communicate information with the protection system 300.

Figure 4:
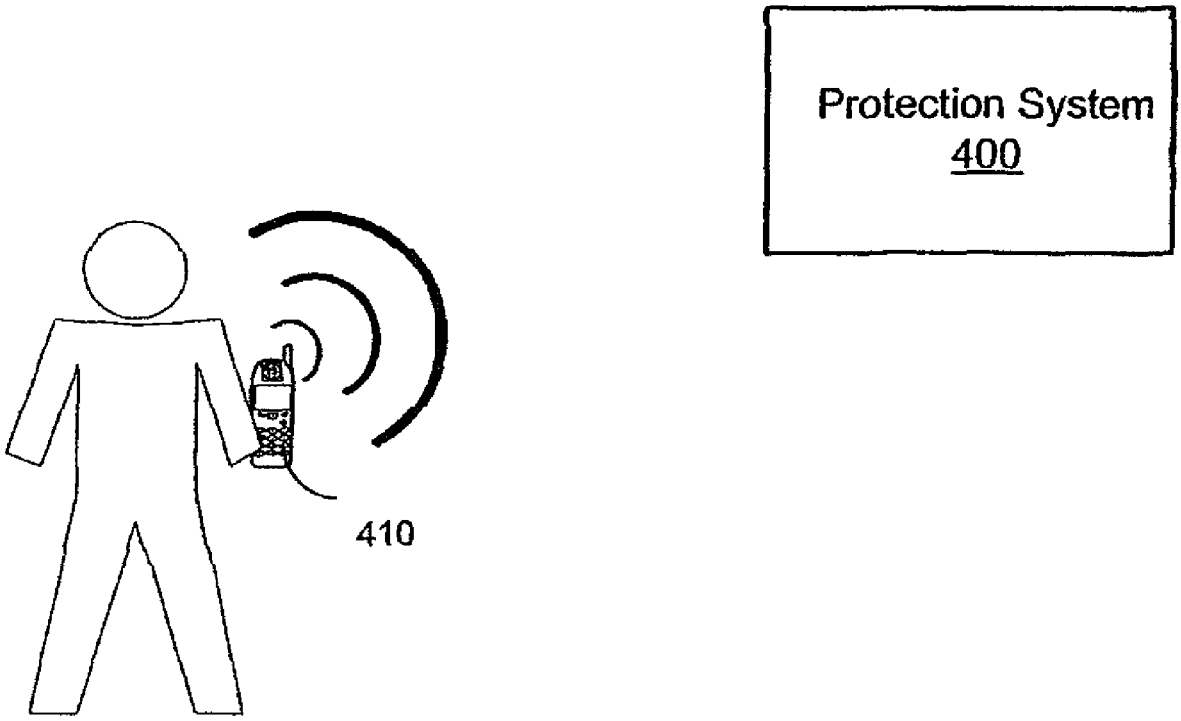
FIG. 4 illustrates an example of a handheld service tool.

FIG. 4 illustrates an example of a service tool 410 configured as a handheld device, such as PDA device. The service tool 410 displays real-time graphical information related to a protection system. The information may be displayed on a screen. The user may move about a building or facility environment with the handheld service tool 410. As the user moves about the environment, the service tool may operate to collect data, diagnose problems, and/or configure the building system 400 using one or different links. Using the interface, a user of the service tool 410 may operate or control the protection system 400 in any of various modes. For example, the service tool 410 may be operated to allow National Fire Protection Association (NFPA) testing.

The service tool 410 also may allow troubleshooting of components, such as an alarm. For example, using the service tool, a technician may request an alarm to acknowledge or operate. Because the service tool 410 remotely operates the field panel, the technician may be proximate the alarm when a command from the service tool to sound the alarm is provided to the field panel. The proper placement and operation of the monitoring or actuating device is determined. The service tool 410 displays the alarm indication from the panel as well. The proper feedback from the device is determined. The technician may silence the alarm using the service tool. Similarly, the service tool may be used for supervisory control and testing of the protection system 400, may identify a malfunctioning device, a ground fault in a circuit or perform other troubleshooting. A single technician may inspect, troubleshoot, commission and/or test the protection system.

Referring to FIG. 3 and as an alternative to providing wireless communications from the controller or workstation 302, a wireless transceiver or device may be integrated or designed into the protection system 300, such as in one or more of the control panels. In an embodiment shown in FIG. 5, a separate communications module 14 wirelessly communicates with the portable service tool 110. The communications module 14 is part of a system for communications and/or reporting in automated protection of a building environment.

The system includes the building protection system for a building or facility. The protection system is one of the protection systems 100, 200, 300 or 400 described above or a different protection system. For example, a fire and/or security protection system has one or more monitoring and/or actuation devices.

The protection system includes one or more control panels 104. The control or field panels connect with the monitoring and/or actuation devices. As used herein, connection is direct or indirect, electrical or physical connection. The control panel 104 operates as a function of control data. For example, a user interface is provided on the control panel. The user interface allows input or control of the protection system for testing, troubleshooting, or commissioning.

The protection system includes a controller 102. The controller 102 may be the workstation 102, the workstation 302 or another controller of the protection system. In other embodiments, the protection system does not include the controller 102.

The protection system also includes the communications module 14, a repeater 18, a remote module 20, and the portable service tool 110. Additional, different or fewer components may be provided. For example, the repeater 18 and/or remote module 20 are not provided.

The communications module 14 connects with the protection system, such as with the control panel 104. The communications module 14 includes an input port for wired or antenna for wireless connection with the protection system and a wireless transceiver for communications with the portable service tool 110. In one embodiment, the communications module 14 includes a processor, the wireless transceiver, a memory, an antenna and an enclosure. Additional, different or fewer components may be provided, such as providing a printer port on the communications module 14.

In a further embodiment, the communications module 14 includes a 900 MHz spread spectrum radio 16, but other wireless communications devices may be used as discussed above. A MINI-ITX, processor with a motherboard (e.g., x386 processor from Intel®) or other processor running a Linux or other application-based program operates the communications module 14. A hard drive (e.g., 20 G byte), RAM, memory stick, or other memory stores data and/or software. A wired interface, such as an RJ12 and associated circuit, is provided for electrical communication with the protection system. Other ports may be provided for communications to the protection system or other devices, such as USB (e.g., four), serial (e.g., two) or parallel ports. An omni-directional antenna connects with the radio 16, but directional or other antennas may be used. A power supply, such as a battery, transformer (e.g., 12 volt) or port for wired power, is provided.

The communications module 14 is integrated into the protection system, such as being within a field panel. Alternatively, the communications module 14 has a separate enclosure, such as a hard metal, plastic and/or fiberglass case. The enclosure is separate from the protection system for external use. The enclosure includes holes, tabs, feet or other structure for mounting or resting the communications module 14 at a desired location. For example, the communications module 14 is mounted to a field panel or to a wall in a same room or adjacent to a field panel 104 or controller 102. The mounting is permanent or releasable, such as using hangers, screws or bolts. As another example, the communications module 14 rests in a same or different room as the controller 102 or field panel 104. The communications module 14 may be connected for testing and removed when not used, retrofitted onto an existing protection system, and/or included in a new protection system.

A port or cable on the enclosure allows electronic connection between the protection system and the communications module 14. For example, a serial cable releasably connects to a port on the communications panel and a port on the field panel 104. A permanent cable may be used from the communications module 14 and/or the protection system.

The radio 16 of the communications module 14 communicates wirelessly. The communication is with the portable service tool 110. The communication is direct. Alternatively and as shown in FIG. 5, the radio 16 wirelessly communicates with an additional device, such as with the remote device 20 for indirect communication with the portable service tool 110. The remote device 20 uses a wired (e.g., serial RS-232C) and/or wireless (e.g., Bluetooth) connection for communicating with the portable service tool 110. One or more repeaters 18 may alternatively or additionally be used for wireless communications with the portable service tool 110. For example, the panel 104 outputs data over a cable to the communications module 14. The port may interface the data for use by the processor of the communications module, such as formatting the data pursuant to the USB standard. The data is output to the radio 16 in any format, such as a spread spectrum signal via RS-232C. The radio 16 transmits the data through an antenna to the repeater 18 and/or remote module 20. The repeater 18 may extend the range of communication between the technician and the communications module 14. Any protocols may be used for any portion of the communications path. Data may be sent from the service tool 110 to the protection system along the same or different communications path.

The data includes event information to or from the portable service tool 110 for annunciation. Control information may be sent from the portable service tool 110, such as data from controlling the panel 104 (e.g., acknowledge (ACK), silence (SIL), RESET & NEXT data). Other data associated with operating the communications module 14 may be sent by the portable service tool 110, such as sending a signal to generate a report, save data, or shut down. Data from the protection system indicating current status or control options may be sent to the portable service tool 110. Any information for commissioning, troubleshooting, and/or inspection may be wirelessly communicated in one-way or two-ways. The communication occurs while the communications module 14 is communicatively connected to both the panel 104 and an additional device, such as the portable service tool 110.

The data passing through or generated in the communications module 14 may be stored on a memory of the communications module 14 or output for storage on another memory. Data from the panel 104, controller 102, and/or the user interface of the portable service tool 110 is logged for later analysis. All or selected testing or other events are logged. Stored data may be recalled for analysis at the portable service tool 110, the panel 104 and/or the controller 102. The data may be stored in one or more locations, such as storing data in a hard drive and in a USB memory stick. The data may be organized in any desired manner, such as by job files or date. Job files are created with the controller 102, the panel 104 and/or the portable service tool 110, such as by saving test data in a job file labeled with input from the user.

The stored or current data may be used to generate an inspection and/or data logging report. The report is based, at least in part, on data from the panel 104. The portable service tool 110 is used to control the testing with or without input at the panel 104. Data from the portable service tool 110, such as a project name, technician name, date or other information, may be included in the report. The data is formatted pursuant to a desired layout, such as an inspection report laid out pursuant to local requirements or a standard format.

For example, at the completion of a system test, the technician closes a test file stored on the communications module 14 with instructions from the portable service tool 110. The test information is then sent to a USB memory stick or other memory for transfer to an inspection tool or software for generating the report. In one embodiment, the inspection tool is on and performed by the communications module 14. The inspection tool lays out the data into an industry standard (e.g., NFPA 72) report to be presented to the customer as written conformation of the test results. The report may avoid hand written reports by taking stored detector point information contained in the panel 104 and importing directly form the actual test information. The report is generated in any desired format, such as a Word® document, an adobe document (e.g., pdf file) or other format.

The portable service tool 110, the controller 102 and/or the panel 104 receive user input to configure the report. For example, the user selects between different types, lay outs or formats of the report. The user may input a report name or other information included on the report. The communications module 14 may be free of user input devices for configuring the report while being the device to generate the report. Alternatively, the communications module 14 includes one or more inputs for configuring a report.

The report may be viewed, such as at the controller 102 and/or the portable service tool 110. The user may review the report for a visual indication that all devices have been tested. Alternatively, software checks data logging to determine completion of testing.

The repeater 18 is a radio, such as 900 MHz spread spectrum radio, for wirelessly linking the communications module 14 to the remote module 20 or the portable service tool 110. The links use a same or different protocol. In one embodiment, the repeater 18 includes an enclosure, a 900 MHz spread spectrum radio, an omni-directional antenna, a power source (e.g., cord, transformer, port or battery with a charger), a switch, a power indicator, a fuse, and a radio connection LED. Additional, different or fewer components may be provided, such as a Bluetooth or other transmitter and/or receiver. In one embodiment, the repeater 18 is a different type of device than the remote module 20. Alternatively, the repeater 18 and the remote module 20 are a same type of device, but perform differently depending on the range to the portable service tool 110. For example, a network of repeaters 18/remote modules 20 is distributed throughout a building. The device closest to the portable service tool at a given time acts as the remote module and no, one or more other devices act as repeaters to communicate with the communications module 14.

The remote module 20 communicates with the portable service tool 110 pursuant to a same or different format as with the repeater 18 and/or communications module 14. For example, Bluetooth communications are used with the portable service tool 110, but a different protocol is used for other wireless communications.

In one embodiment, the remote module 20 comprises an enclosure, a 900 MHz spread spectrum radio, an omni-directional antenna, a power source, a serial Bluetooth transmitter/receiver, a switch, a power indicator, a fuse, and radio connection LEDs. Additional, different or fewer components may be provided. The remote module 20 may include a serial Bluetooth adaptor and be pocket PC Bluetooth enabled, but other communications may be used. A charger port for the portable service tool or an extra battery may be provided with the remote module 20. The remote module 20 implements a TELNET or other application for routing communications.

The enclosure of the remote module 14 is adapted to rest or mount within the building. Alternatively, the remote module 14 is portable, such as being carried with or by the technician. A belt connector, backpack, or shoulder strap may be provided. In other embodiments, the remote module 20 and the portable service tool 110 are combined as a single device in one or more enclosures.

900 MHz Radios may have a range of about 1,000 feet unobstructed, but have a lesser range in a building environment. To extend the range in larger buildings, one or more repeaters 18 are provided. Other wireless devices with a greater or lesser range may be used.

The portable service tool 110 is the portable service tool of FIG. 1, or another portable service tool (e.g., 210, 310 or 410). In one embodiment, the portable service tool 110 is adapted for or specific to use in the building protection system, such as being a SAP compliant device. The portable service tool 110 may be a general application device with or without modifications other than software, such as a personal data assistant or wireless telephone. In one embodiment, the portable service tool 110 includes a Windows or Palm operating system, a Bluetooth interface, and a MToken or like serial telnet program. Additional, different or fewer components may be provided, such as replacing or adding to the Bluetooth interface with a serial cable connection.

The portable service tool 110 provides a user interface to display visually processed information in a user readable format. The information includes status information for the protection system, control options, report configuration options, portable service tool 110 operation options, and/or communications module 14 operation options. Data is sent to and from the portable service tool 110, such as communicating commands for the panel 104 or protection system from the portable service tool 110 in response to selections by the user on the user interface.

In another embodiment, the data is routed, at least in part, to or from the portable service tool 110 by a computer network. FIG. 6 shows a computer network 30 for use with the communications module 14 and the portable, remote service module 110. The computer network 30 includes one or more wireless communications devices or radios 34 (e.g., nodes), such as wi-fi devices, and a remote component 32. Additional, different or fewer components may be provided, such as providing the radios 34 without the remote component 32 or vise versa.

The computer network 30 is operable pursuant to any now known or later developed network protocol, such as the TCP/IP or others. In one embodiment, the computer network 30 is a local area network. In other embodiments, the computer network 30 is a wide area network and/or connects with other networks, such as the Internet.

A connection allows communications between the panel 104 or controller 102 with the computer network 30. The connection is a wired connection, such as a RS-232 connection with the panel 104. For communicating with the computer network 30, the panel 104, controller 102, communications module 14, any repeater 18, or any remote module 20 includes an Ethernet, modem, USB, serial, parallel, IEEE 1394, or other interface operable with the computer network 30. Wireless connection may be used.

In one embodiment, the connection is free of the communications module 14. In the embodiment shown in FIG. 6, the communications module 14 provides the connection. The communications module connects with the panel 104 or controller 102 and with the connection to the computer network 30. For example, the communications module 14 is plugged into the computer network for transmitting status data and receiving control data. The communications module 14 is assigned or provides a network address. Other data may be transferred, such as updated firmware or software for the portable service tool 110, the panel 104, the controller 102, or the communications module 14.

In one embodiment, the repeater 18 and/or the remote module 20 (FIG. 5) are replaced or supplemented by wireless capabilities of the computer network 30 in a building, such as the radios 34. The portable service tool 110 includes wi-fi or computer network based wireless capabilities or communicates through an interface, such as a remote module 20. The connection with the computer network 30 through the radios 34 routes control data to the panel 104 or controller 102 from the portable service tool 110. The connection of the computer network 30 with the protection system (e.g., panel 104, controller 102 or communications module 14) receives the control data from one or more nodes or radios 34. Status data is routed to the portable service tool 110 through the nodes or radios 34. As the portable service tool 110 is carried to different locations in a building, different radios 34 of the computer system 30 are used to communicate between the protection system and the portable service tool 110. At different times, different radios 34 may provide the best connection based on the location of the portable service tool 110 given the operable range for wireless communication.

In an alternative or additional embodiment, the connection and computer network 30 are used for remote communications outside the building environment. The remote component 32 is a computer or service tool at a different building, facility, city, state or other geographical location. For example, the remote component 32 is a computer at a service center, technician business, manufacture location or elsewhere. Using the Internet or other computer network communications, the status data for the protection system is transmitted to the remote component 32. The status data may be displayed or analyzed to assist in troubleshooting or testing. An expert or other person may contact a technician to assist. Alternatively or additionally, control data may be generated at the remote component 32 and received at the connection with the protection system. The protection system operates based on the control data, providing for remote testing or troubleshooting.

The operation with the remote component 32 may be used alone or in conjunction with wireless communication with a portable service tool 110. For example, the status and/or control data is mirrored at the remote component 32 and the portable service tool 110. A data, voice or other communications routed between the remote component 32 and the portable service tool 110 through the network 30 with or without the communications module 14 may be provided.

FIG. 7 shows one example of a screen display on the portable service tool 110. Other information may be provided. The display mirrors or includes the same data as a display of the panel 104 and/or the controller 102, but may have different format or content. The top two lines comprise a simple panel display format. The status data includes a number of alarm, trouble, supervisory, and security notices for a given job selected from a list of jobs or currently being operated. The supervisory notices deal with flow and control switching. The trouble notices deal with unusual or no signals, such as associated with a short, open or removal of a device. The reset, display, next and quit inputs allow for navigation through the various notices. Other inputs are shown, such as alarm acknowledgement, silence audible, supervisory acknowledge, trouble acknowledge and security acknowledge. Other status indicators may be displayed, such as alarm, power, audible silence, partial system disable, supervisory, trouble and security indications with an appropriate designator (e.g., off, on, blinking for active, and ? for unknown).

The systems of FIGS. 5-6 are used in a method for communicating and/or reporting in automated protection of a building environment. Other systems may be used.

The protection system monitors one or more devices with a panel and/or controller. The devices may indicate fire, security or other building environment conditions. To verify proper operation, commission, change, troubleshoot or inspect the protection system, the user may operate tools on the panel or controller. User input controls operation of monitoring devices, actuator devices or the panel. To assist in control, a portable service tool may be used to control the panel. The portable service tool is a handheld device, but may be larger.

In one embodiment, a transceiver device is connected with and near a panel or controller of the building protection system. For example, the transceiver device electrically connects with a cable. The transceiver device, such as a communications module, connects with a communications port on the panel or controller. As another example, the transceiver device physically connects on a housing of or structure near the panel or controller. The transceiver device is in a separate housing from the panel or controller. The electrical and/or physical connection may be releasable or fixed. Alternatively, the transceiver device is provided within, on a same board or as part of the panel or controller.

Based on the monitoring of devices, the panel and/or controller generate one or more output signals. Status information for each or groups of the devices is output. Logged events may be output. The output data is communicated from the panel and/or controller to the transceiver device.

The transceiver device receives the output signal. For example, the transceiver device receives status information representing operation of the entire or a portion of the protection system. The output signal is digital or analog.

The transceiver device wirelessly transmits the data associated with the output signal. The data is transmitted as an analog or digital signal. Any now known or later developed format may be used, such as spread spectrum, frequency division, time division or combinations thereof. The data associated with the output signal is the actual output information or data derived from the output information. For example, the status information is output in packets pursuant to a protocol useable by other devices, such as a handheld user interface. The data is output to the handheld or portable device.

The handheld user interface receives the data. In one embodiment, a remote module receives the data directly or indirectly from the transceiver device and transmits the information to the handheld user interface. The transmission is wireless or wired. For example, the remote module receives the data wirelessly pursuant to a longer range protocol (e.g., spread spectrum at 900 MHz or other frequency) and converts the data as appropriate for a shorter range protocol (e.g., Bluetooth). The handheld user interface is adjacent to one or more remote modules at a given time for receiving the data. Alternatively, the handheld user interface receives the data pursuant to the protocol used by the transceiver device with or without one or more intervening devices.

The handheld user interface displays a status of the building protection system as a function of the received data. The user interface allows input of a control entry. The user may enter control information on the portable component, such as selecting an acknowledge, silence, diable, next, reset, quit, save, combinations thereof, or other now known or later developed protection system control. The user selects the control information independent of or based on the displayed status.

The handheld user interface (e.g., the portable component) transmits control information in response to the control entry. The control information is transmitted along a same or different path as the received information (e.g., status data). For example, the control information is formatted for wireless transmission pursuant to the Bluetooth protocol to the remote module, and the remote module converts the control information for wireless transmission to the transceiver device. Other formats or protocols may be used. Wired communication may be used.

The transceiver device (e.g., communications module) at the panel or controller receives the control information from the handheld user interface. The transceiver device transmits the control information in a same or different form to the panel and/or controller. For example, the carrier information is removed, and digital data representing control information used by the panel is transmitted. Data derived from the received control information may be transmitted to the panel or controller.

The building protection system changes operation in response to the received control data. The operation changes as if the user had input control selections at the panel or controller, but without requiring the user to be present at the panel or controller. The change may result in different operation of the monitoring devices, actuation devices, panel and/or controller. For example, an audible alarm at one or more speakers is silenced. As another example, the building protection system or a portion of the system is reset. The change may result in the storage of data, such as being a save command.

Any resulting change in status may be transmitted to the handheld user interface using the same or different path. The exchange of control and status data may continue for testing different or the same devices of the protection system.

In response to a command or without responding to a command, the transceiver device (e.g., the communications module) generates a report. As the panel is controlled with the portable component, the testing data for the report is generated. The report is a function of information from the panel, controller, portable device or combinations thereof. For example, status information from the protection system is logged. Control information may be logged. The report is a data logging or an inspection report for the panel, controller or other portion of the protection system.

The transceiver device generates the report in a standardized report format. The report has a single configuration in one embodiment. In other embodiments, the user controls some of the data and/or layout of the report. This configuration of the report is controlled by user input on the portable device, the transceiver device or other sources. The report may be generated without configuring data from the transceiver device in one example, such as where the transceiver device has a limited user interface. The command to output or generate may be generated at the handheld user interface, the transceiver device, the protection system or elsewhere.

The report is output. The report is in a standard or proprietary format, such as being a .pdf or .doc file. The report is output to a memory or on an output port. For example, the report is output for display on the handheld user interface. As another example, the report is output on a printer port. In another example, the report is stored to an internal memory, output to a removable memory (e.g., disk, optical media, or memory stick), or output to a computer network.

In another embodiment, the panel or controller of a building protection system is connected with a computer network. A user or another connects with a wire, but a wireless device may be used. For example, the panel or controller is connected to the Internet, a local area network, a wide area network or other network. The computer network is operable pursuant to an Internet Protocol, but other protocols may be used. The connection is direct or indirect. For example, a communications module is connected with the panel or controller and with the computer network. The communications module performs transmitting and receiving of data between the protection system and the computer network.

The computer network may include a wireless capability. For example, the computer network provides a wi-fi capability in a portion of or in an entire building or groups of buildings. A portable device used within the building environment wirelessly communicates with the computer network. The communication may be only for portions of the building, with other wireless communications being for other portions.

The portable device and the protection system communicate status and control data through the computer network. For example, the panel or controller receives control data from the portable device at least in part with a wireless communications capability of the computer network. The portable device communicates with a closest, most reliable, or selected wireless node of the computer network. As the portable device is moved to other locations, other wireless nodes of the computer network may be used for communications. At different times, different wireless nodes may be within an operable range for wireless communication with the portable device.

The protection system sends status and receives control information with the computer network. The information may be communicated over a wire or wireless. For example, a wired connection between the protection system and a communications module and a wired or wireless connection between the communications module and the computer network are used to transmit status data.

The connection of the protection system with the computer network has an alternative or additional use. A component of the computer network, such as a computer, may be used to receive status information and/or transmit control information. The component of the computer network performs the same, some of the same, or different functions as the portable service tool. The portable service tool is or is not provided. The panel or controller transmits status information to the component of the computer network and/or the portable device.

The component of the computer network is within the building environment or is remote from the building environment. For example, a computer connected to the Internet is located at provider or manufacturer of the protection system or another expert location. A technician in the building environment may be assisted in testing, commissioning or troubleshooting by someone else using the component of the computer network. The other person may review the status of the protection system and/or control the protection system. The protection system receives control data from the component and operates the panel as a function of the control data. The performance of the protection system may be monitored and/or controlled by the component without the presence of the technician in the building environment.

Software to be used or applied by the protection system, portable service tool, communications module, or combinations thereof may be updated or provided from the computer network. For example, the component sends a software upgrade over the computer network. The addressed device receives and loads the software upgrade. A status of the loading may be sent back to the component of the computer network.

While the invention has been described above by reference to various embodiments, it should be understood that many changes and modifications can be made without departing from the scope of the invention. For example, the service tool and its components may be adapted for servicing and troubleshooting industrial control equipment, environmental quality, security, lighting systems and integrated systems including combinations thereof. The service tool may also be configured with mapping software that allows a user to record and store service information with a corresponding position on a map of a building. The service tool may be used with integrated systems where, for example, an environmental control system may be integrated with a fire detection and prevention system.

The description and illustrations are by way of example only. Many more embodiments and implementations are possible within the scope of this invention and will be apparent to those of ordinary skill in the art. The various embodiments are not limited to the described environments, and have a wide variety of applications including integrated building control systems, environmental control, security detection, communications, industrial control, power distribution, lighting control, and hazard reporting.

It is intended that the appended claims cover such changes and modifications that fall within the spirit, scope and equivalents of the invention. The invention is not to be restricted except in light as necessitated by the accompanying claims and their equivalents. Therefore, the invention is not limited to the specific details, representative embodiments, and illustrated examples in this description.

We claim:

1. A system for communications in automated protection of a building environment, the system comprising:

a protection system for a building, the protection system including a plurality of field panels, each of the plurality of field panels associated with one or more zones of the protection system and each of the plurality of field panels in wired communication with one or more monitoring devices, wherein the protection system comprises a fire, security or fire and security system; and at least one communications module connected with at least one of the plurality of field panels of the protection system, the at least one communications module operable to communicate wirelessly with a portable service tool, wherein the portable service tool is configured to control operation of the at least one of the plurality of field panels such that the field panel controls operation of an individual one of the one or more monitoring devices, and wherein the portable service tool is configured to control operation of the at least one of the plurality of field panels in a manner that causes the field panel to send an instruction to trigger an alarm associated with the one or more monitoring devices.

2. The system of claim 1 wherein the communications module is external to the protection system such that the communications module does not provide a connection between the plurality of field panels and the one or more monitoring devices, the communications module connected with a communications port on the protection system.

3. The system of claim 1 wherein the communications module comprises a spread spectrum radio.

4. The system of claim 1 wherein the communications module comprises a processor, a wireless transceiver, a memory, an antenna and an enclosure.

5. The system of claim 1 wherein the communications module is operable to communicate with the portable service tool through a remote module.

6. The system of claim 5 wherein the communications module is operable to communicate with the remote module pursuant to a first protocol and the remote module is operable to communicate with the portable service tool pursuant to a second protocol different than the first protocol.

7. The system of claim 5 wherein the communications module is operable to communicate with the portable service tool through the remote module and at least one repeater.

8. The system of claim 1 wherein the communications module is releasably connected to the at least one of the plurality of field panels.

9. The system of claim 1 wherein the portable service tool further comprises:

a transceiver operable to communicate wirelessly with the communications module;

a controller configured to process information received from the communications module at the transceiver, the information being from the protection system and routed through the communications module; and a user interface operable to display visually the processed information in a user readable format.

10. The system of claim 9 wherein the information comprises a status of at least one of the one or more monitoring devices.

11. The system of claim 9 wherein the controller is operable to transmit with the transceiver a command for the protection system, the command being responsive to information from the user interface and operable to control the protection system.

12. A system for communications in automated protection of a building environment, the system comprising:

a protection system for a building, the protecting system having a plurality of field panels associated with one or more zones of the protecting system, each of the plurality of field panels having a wired connection to one or more monitoring devices, wherein the protection system comprises a fire, security or fire and security system;

a communications module external to the protection system such that the communications module does not provide a connection between the plurality of field panels and the one or more monitoring devices, the communications module connected with a communications port on the protection system and operable to communicate wirelessly, wherein the communications module comprises a processor, a wireless transceiver, a memory, an antenna and an enclosure separate from the protection system;

a portable service tool, the portable service tool comprising a transceiver operable to wirelessly communicate with the communications module through a remote module, a controller configured to process information received from the communications module at the transceiver, the information being from the protection system and routed through the communications module, and a user interface operable to visually display the processed information in a user readable format, wherein the information comprises a status of at least one of the one or more monitoring devices and wherein the controller is operable to transmit with the transceiver a command for the protection system, the command being responsive to information from the user interface and operable to control the protection system.

13. The system of claim 12 wherein the communications module connects with the communications port with a releasable cable.

14. The system of claim 12 wherein the remote module is positioned within the building.

15. The system of claim 12 wherein the protection system comprises a control panel, the communications module releasably connected to the control panel.

16. A method for communications in automated protection of a building environment, the method comprising:

connecting a transceiver device to one of a plurality of field panels of a building protection system, each of the plurality of field panels associated with one or more zones of the building protection system;

monitoring, with the one of the plurality of field panels, one or more monitoring devices;

generating by the one of the plurality of field panels at least one output signal as a function of the monitoring;

receiving by the transceiver device the at least one output signal;

wirelessly transmitting data associated with the at least one output signal from the transceiver device to a handheld user interface;

receiving with the transceiver device first control data from the handheld user interface;

transmitting second control data comprising the first control data or data derived from the first control data from the transceiver device to the one of the plurality of field panels;

changing operation of the building protection system in response to the second control data, wherein changing operation of the building protection system involves controlling the operation of the one or more monitoring devices by sounding an alarm;

receiving with the transceiver device third control data from the handheld user interface; and further changing operation of the building protection system in response to the third control data, wherein changing operation of the building protection system involves silencing the alarm.

17. The method of claim 16 wherein connecting comprises electrically connecting with a cable.

18. The method of claim 16 wherein connecting comprises physically connecting the transceiver device on a housing of the one of the plurality of field panels.

19. The method of claim 16 wherein connecting comprises releasably connecting the transceiver device, the transceiver device being in a separate housing from the one of the plurality of field panels.

20. The method of claim 16 wherein generating comprises generating status information, receiving comprises receiving the status information, and wirelessly transmitting comprises transmitting the status information.

21. The method of claim 16 further comprising:

receiving the data at the handheld user interface, the handheld user interface being adjacent at least one of the one or more monitoring devices;

displaying a status of the building protection system as a function of the received data;

inputting a control entry on the handheld user device; and transmitting the first control data in response to the control entry.

* * * * *